US007874301B2

(12) United States Patent
Breitschuh

(10) Patent No.: US 7,874,301 B2
(45) Date of Patent: Jan. 25, 2011

(54) WASHING CONTAINER

(75) Inventor: Axel Breitschuh, Offenburg (DE)

(73) Assignee: MEIKO Machinenbau GmbH & Co. KG, Offenburg (DE)

( * ) Notice: Subject to any disclaimer, the term of this patent is extended or adjusted under 35 U.S.C. 154(b) by 429 days.

(21) Appl. No.: 11/964,433

(22) Filed: Dec. 26, 2007

(65) Prior Publication Data

US 2009/0014038 A1 Jan. 15, 2009

Related U.S. Application Data

(60) Provisional application No. 60/907,161, filed on Mar. 23, 2007.

(30) Foreign Application Priority Data

Dec. 22, 2006 (DE) ..... 10 2006 062 228

(51) Int. Cl.
*B08B 3/02* (2006.01)

(52) U.S. Cl. ..... 134/104.1; 134/130; 134/133

(58) Field of Classification Search ..... 134/104.2, 134/130, 133, 201; 137/561
See application file for complete search history.

(56) References Cited

U.S. PATENT DOCUMENTS 2,802,475 A * 8/1957 Stine ..... 134/60
2,949,120 A * 8/1960 Federighi et al. ..... 134/115 G
3,413,989 A * 12/1968 Kochendorffer ..... 134/128
3,698,407 A * 10/1972 Noren ..... 134/60
3,843,976 A * 10/1974 Miya et al. ..... 4/300
4,642,195 A * 2/1987 Nill ..... 210/798

* cited by examiner

*Primary Examiner*—Frankie L Stinson
(74) *Attorney, Agent, or Firm*—Ronald E. Greigg

(57) ABSTRACT

The invention relates to an entry region of a conveyor-type dishwasher. A conveyor belt which moves in the conveying direction is located in the entry region. The entry region comprises a trough base which is bounded by sidewalls arranged laterally. The entry region contains at least one washing container which stores a stock of fluid and, upon emptying, cleans the trough base.

20 Claims, 3 Drawing Sheets

WASHING CONTAINER

CROSS REFERENCE TO RELATED APPLICATIONS

Figure 1:
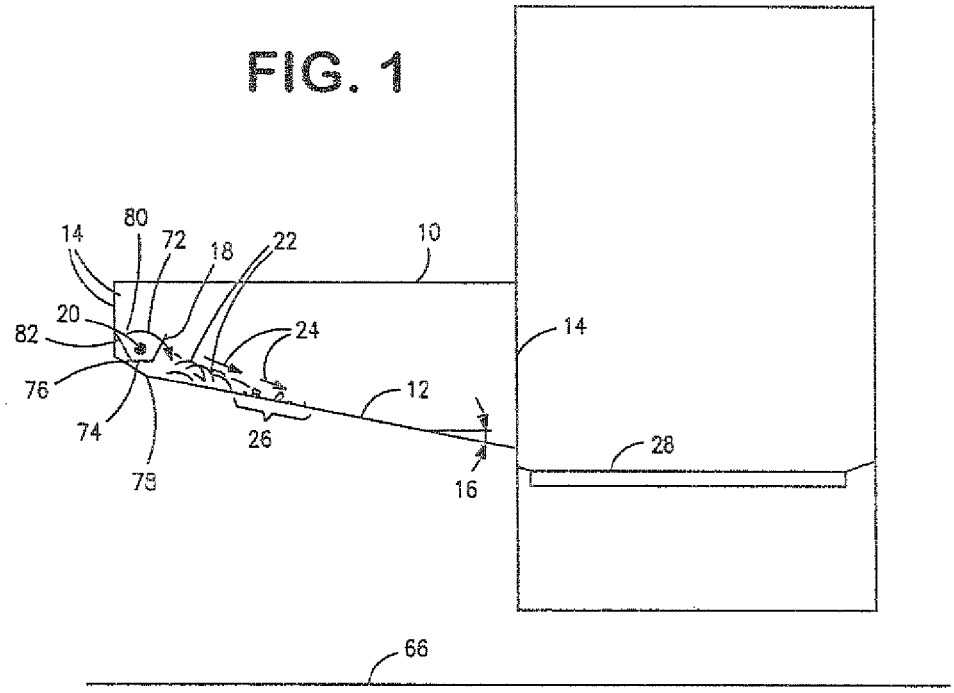

This application is based on German Patent Application No. 10 2006 062 228.6 filed 22 Dec. 2006, upon which priority is claimed, and on Provisional Application 60/907,161 filed on Mar. 23, 2007.

BACKGROUND OF THE INVENTION

1. Field of the Invention

The present invention relates to dishwashers, and more particularly to entry points of conveyor-type dishwashers, whether conveyor-belt machines or basket transport machines, with a trough-rinsing system integrated into the entry point.

2. Prior Art

DE 44 28 738 A1 discloses a conveyor-type dishwashing machine comprising a preliminary cleaning stage, a plurality of main rinsing stages and an after-rinsing stage. A heat exchanger which serves to recover heat is provided. In order to improve the access, the possibility of cleaning and the efficiency of the heat exchanger, the latter is arranged within the preliminary cleaning stage of the conveyor-type dishwashing machine under the conveyor of the items to be cleaned in such a manner that heated washing water can drop directly onto the heat exchanger surface. The heat exchanger surface is expediently designed as a smooth flat cooling plate and simply arranged below the entry trough. The pipes of a further heat exchanger surface, through which cool fresh water is supplied, can run in or below the cooling plate. Specially designed collecting troughs can be provided for the pipe supplying the washing water to a cleaning stage.

DE 198 36 739 A1 discloses a dishwashing machine which has a collecting device for washing water and an outlet device and also a centrifugal separator for the washing water. In order to increase the cleaning action and to reduce the detergent requirement, the clean water which is guided upward out of the centrifugal separator is supplied directly to a waste water spraying device of a treatment zone. In the at least one treatment zone, at least one collecting container for washing water is arranged below the rinsing device. Said collecting container is connected to a discharge pipe and has a level limitation for the washing water. From the collecting container, a supply device runs to the spraying device, within which a recirculating pump is arranged.

In the centrifugal separator, which is supplied with washing water under pressure from the collecting container via a supply pipe and a recirculating pump, the washing water is separated into largely clean water which is conducted upward into the treatment zone above the collecting container, and into dirt water which is conducted into the waste pipe. The clean water from the centrifugal separator is supplied as spray water directly to the water-spraying device for the items to be cleaned.

The publication "Bandtransportautomat B-Tronic, Das Chemiesparsystem CSS, CSS Top . . . bis zu 80% Einsparpotential" [B-Tronic Automatie Conveyor-Belt machine, Chemical saving system CSS, CSS Top . . . up to 80% potential savings] reveals an extended entry tunnel for an automatic conveyor-belt machine. An integrated, additional preliminary rinsing-off system with a dedicated tank is arranged within the extended entry tunnel. Furthermore, permanent filtering of suds is implemented via two cyclones, and intermediate rinsing is possible. Within the intermediate rinsing context, fresh water is removed from the pump-operated final-rinsing zone and is conducted into the entry tunnel of extended design such that food residues can be highly effectively rinsed off even before the regular washing and rinsing zones. This firstly results in minimal emulsifying of fats and oils and, secondly, a heat exchanger for virtually cost-free preliminary heating of fresh water can be provided by this solution.

In the case of the conveyor-type dishwashers known from the prior art, whether conveyor-belt machines or basket transport machines, a trough base is generally provided on the unclean side within the machine entry point. A transporting belt which is preferably of endless design and on which different items to be cleaned are loaded automatically or manually either in catch pegs or in transporting baskets circulates above the trough base. During loading of the transporting means, food residues, serviettes, paper or other waste drop off or drip off from the items to be cleaned and are either collected by previously inserted covering sieves which entirely or partially cover the trough base, or drop directly onto the trough base, which results in an increased outlay on cleaning the trough base in the entry region at the end of operation.

The use customary nowadays of covering sieves, whether large-mesh or fine-mesh sieves, has a number of disadvantages. The covering sieves only collect the dirt which is larger than the opening diameter of the openings of the covering sieve. Dirt fragments which pass through the covering sieves remain on the trough base. The covering sieves are to be regularly emptied and cleaned, since otherwise there is a risk of the sieve plate becoming clogged or the covering sieves becoming overfilled. The removal of the covering sieves which are partially or completely filled with dirt and are therefore heavy is not user-friendly for ergonomic reasons. In order to clean the heavy covering sieves, the entire rinsing process has to be interrupted, depending on the location at which the covering sieves are used, and therefore the use of covering sieves and the cleaning, which is inevitably associated therewith, after the end of operation cause an additional expenditure of time and therefore additional costs.

In order to provide a remedy, structures have been devised, in which the food residues, some of which drop onto the trough base, are washed away by a trough-rinsing means into a dirt-collecting sieve. Said trough-rinsing means comprises at least one nozzle which is mounted in the trough base and which, during the rinsing mode, produces a thin water film which flows in the direction of a dirt-collecting sieve which may be present. However, this thin and therefore low-energy water film can only convey the smallest dirt fragments which pass through the sieves to the dirt-collecting sieve; larger dirt particles inevitably remain stuck to the trough base. This necessitates the use of large covering sieves and has the disadvantage that large food residues cannot be conveyed in the direction of the dirt-collecting sieve by the only thin and low-energy water film which flows along the slightly inclined trough face.

SUMMARY OF THE INVENTION

The present invention is based on the object of firstly avoiding the disadvantages of the solutions known from the prior art and of secondly providing a solution with which machine entry points can be continuously cleaned from food residues and the use of covering sieves, in particular of large design, can be completely omitted.

In order to achieve effective cleaning of the trough base within the entry region and to produce the washing-away action required there, a certain quantity of water is collected in at least one flushing or washing container and is regularly poured out onto the trough base which has an incline or gradient in the direction of a dirt-collecting sieve. By means of the large and high-energy gush of water produced, small and larger food residues which may have already stuck to the trough base, and paper, serviettes and other waste, such as, for example, fruit peelings, cores, shells and more of the same, are washed away along the gradient in the direction of the dirt-collecting sieve by the water film which is produced in the manner of a gush of water. The emptying of the washing container can be achieved in a very simple manner in that, owing to a shifting of the center of gravity via the axis of rotation of the continuously filling washing container, the latter is deflected by its dead weight and empties. The filling position, i.e. the position in which the washing container is filled, is defined by a stop position of the washing container which is preferably mounted rotatably in the entry region. If the washing container has dispensed a certain amount of collected water, its dead weight and its rotatable mounting bring it back again into the filling position.

The deflection of the washing container can also be brought about forcibly via a drive, for example an electric drive, which moves the washing container within certain preselectable intervals of time from its pouring-out position into its filling position and vice versa. In conjunction with the circulation of the transporting belt, via which the items to be cleaned are transported through the automatic conveyor-type dishwashing machine, both positions may also assume a certain chronological sequence.

Furthermore, a spring system can be used in order to actuate the washing container to move it from its filling into its pouring-out position and vice versa. The quantity of water stored in each case in the washing container can also take place via a level sensor arranged, for example, on a side wall or on a longitudinal wall of the washing container.

In addition to a deflection of the washing container owing to a shifting of the center of gravity of the same during filling, emptying of the washing container can also be achieved by opening the base of the washing container.

In order to fill the water or washing container, washing water can be used from any desired tank of the conveyor-type dishwasher, whether the tank in the preliminary cleaning zone, whether a tank within the washing zone, whether a pump-operated final-rinsing tank, or whether fresh water is used. If fresh water is used, a better cleaning effect can advantageously be obtained.

The washing container is preferably situated at the highest point of the trough base within the entry region, and therefore cleaning is most effective, since the entire gradient of the trough base in the direction of a dirt-collecting sieve can be used. In the case of relatively long entry points, a plurality of pivotable washing containers, the emptying of which is brought about by a shifting of the center of gravity, can also be fitted. The washing container can also be used in the case of trough bases which have a gradient in both directions, and, in this case, is arranged at the apex point between the two gradient sections of the trough bases. In this embodiment, the washing container can be regularly or irregularly emptied in both directions. In this case of use, the stop position for the filling operation is switched over depending on the emptying direction.

The water container used as the washing container is preferably designed in such a manner that it is open toward its upper side in order to also discharge the quantity of water which produces the water film in the manner of a gush of water from the container. If a plurality of water containers used as washing containers are inserted at a machine entry point, the water containers may differ in shape and size in order to produce different washing-away times and different quantities of water and therefore water films of differing energy. The shape of the water container used as a washing container may be asymmetrical or symmetrical. If the water container used as the washing container is of symmetrical design, the advantage arises that said water container, for example after being removed for cleaning, can be inserted again into the entry region in its correct fitted position.

The water container used as the washing container is fitted in such a manner that it can be removed in a simple manner with just a few actions and can be cleaned in a simple manner. With the emptying of the filled water container serving as the washing container, large food residues, papers, serviettes or other waste can be washed away, and therefore no covering sieves whatsoever are required in the machine entry region of the solution proposed according to the invention. The removal and cleaning of the covering sieves and the soiling, necessitated by the cleaning of the covering sieves, of the kitchen region in which the automatic conveyor-type dishwasher is erected are therefore not needed. Furthermore, staff costs are reduced, since the implemented cleaning of the entry region means that the cleaning thereof at the end of the operation can be dispensed with, as can possible down times of the machine. In comparison to the production costs of previously used covering sieves, the production costs for the water container which is proposed according to the invention and serves as a washing container are low. In an alternative embodiment, it is possible to use the entry region cleaning proposed according to the invention and having at least one water container serving as a washing-away container in combination with a nozzle producing a water film. The degree of soiling of the machine entry point decreases by means of the solution proposed according to the invention, and therefore the previous outlay on cleaning can be considerably reduced.

BRIEF DESCRIPTIONS OF THE DRAWINGS

Figure 2:
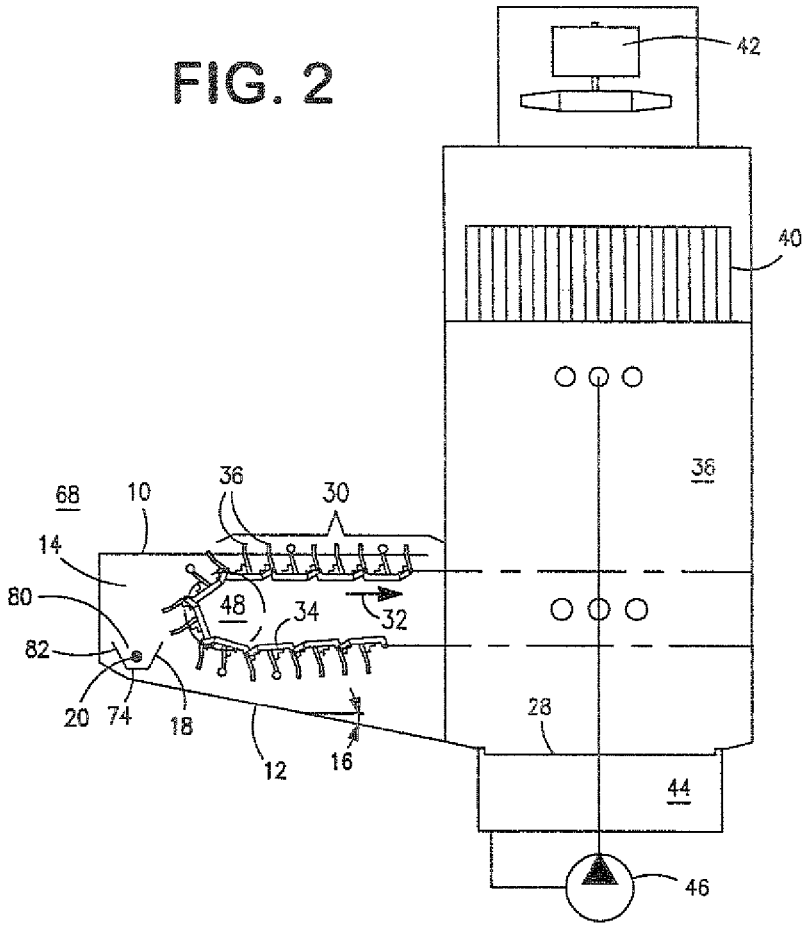
Figure 3:
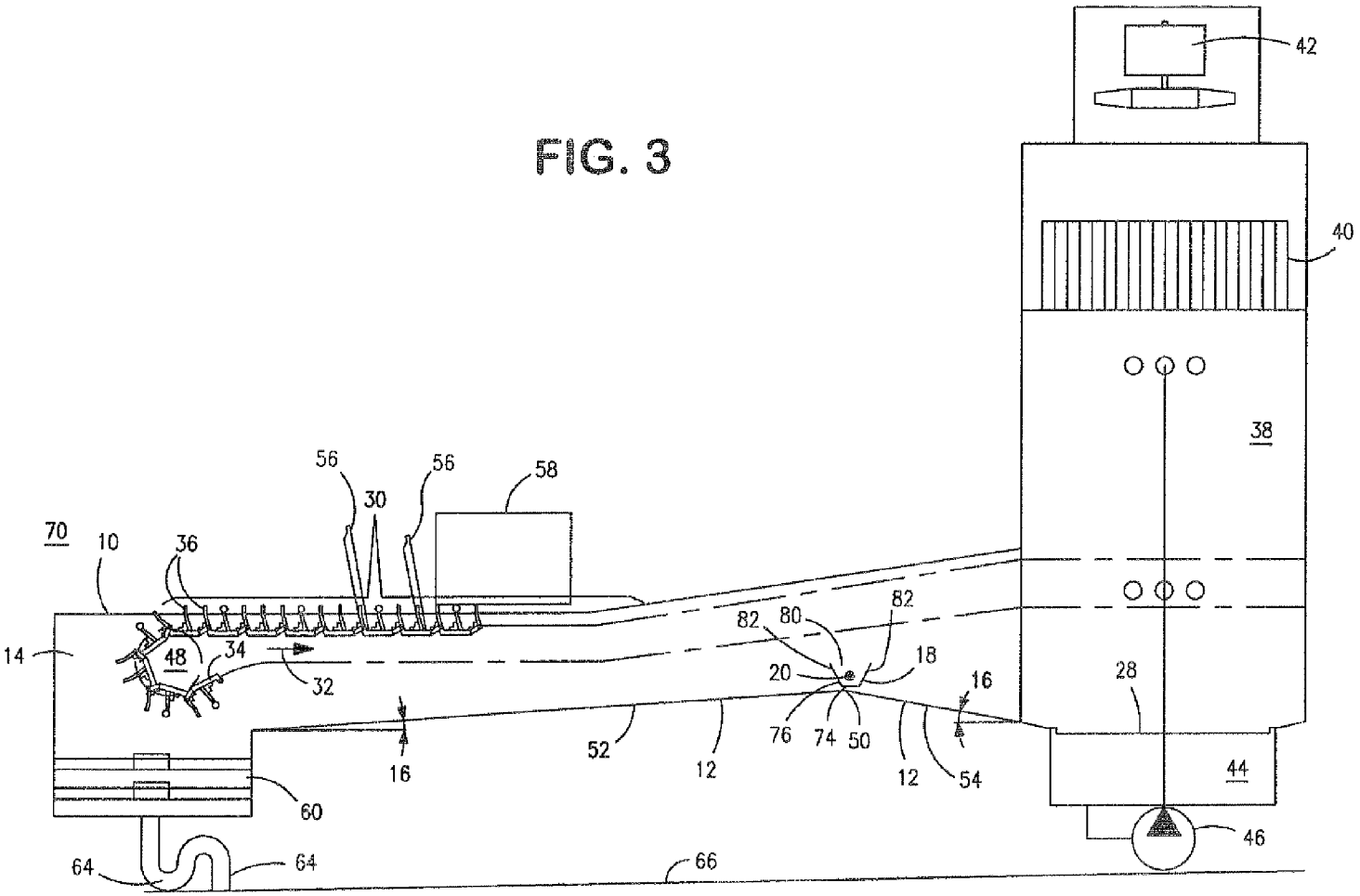
Figure 4:
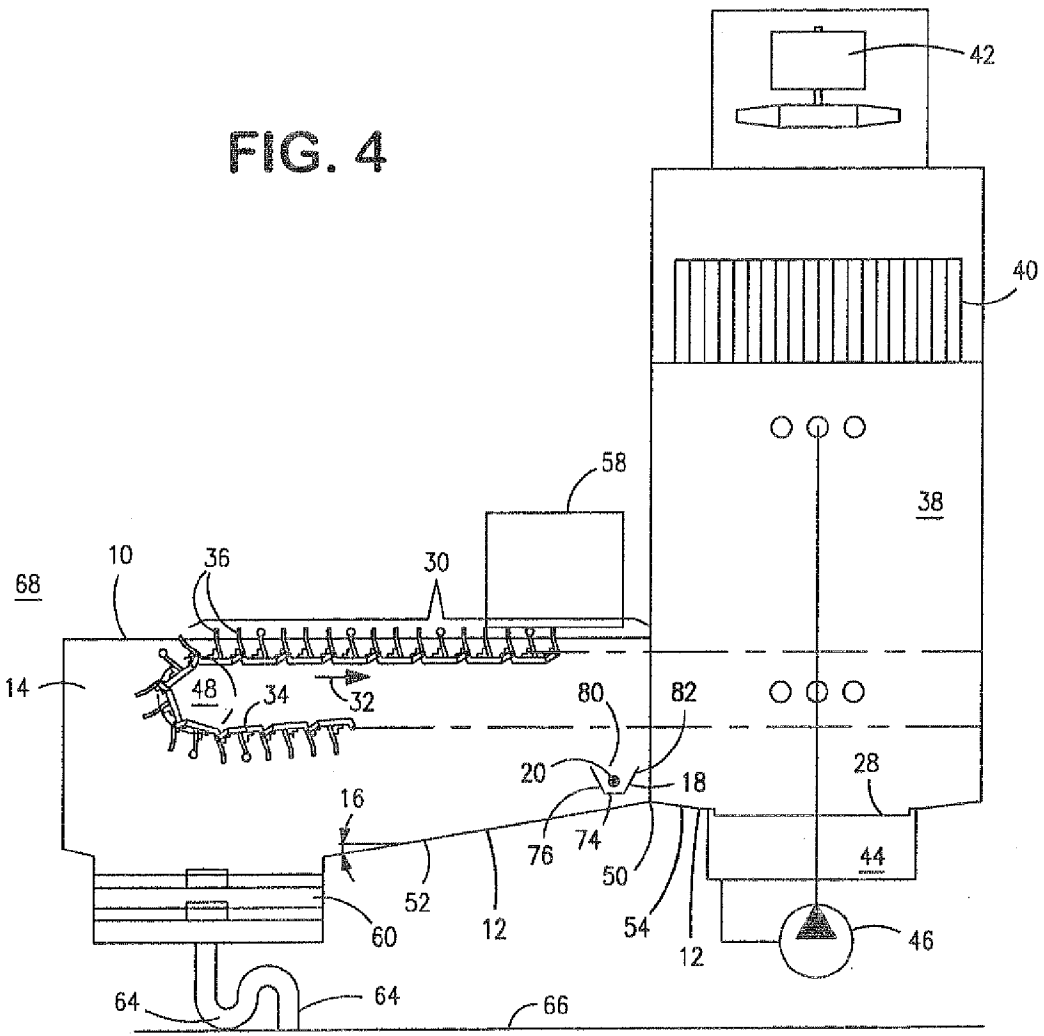

The invention is described in more detail below with reference to the drawing, in which:

FIG. 1 shows a schematic reproduction of an entry region designed according to the invention for a conveyor-type dishwasher, FIG. 2 shows an illustration of the entry region of a conveyor-type dishwasher with an encircling, continuous conveying device, FIG. 3 shows an embodiment of a conveyor-type dishwasher with an entry region which is lowered with respect to a first washing zone, and FIG. 4 shows a conveyor-type dishwasher, the entry region of which runs essentially horizontally, with the trough base of the entry region having two slopes.

DESCRIPTION OF THE PREFERRED EMBODIMENTS

A first embodiment of the dishwasher entry region proposed according to the invention can be gathered from the illustration according to FIG. 1 which shows an entry region 10, in particular of a conveyor-type dishwasher, whether a basket transport machine or a conveyor-belt machine. In the illustration according to FIG. 1, an encircling transporting belt, on which either holding devices for receiving the items to be cleaned or holding devices for receiving baskets which, for their part, receive the items to be cleaned are provided, is not reproduced for reasons of better illustration.

The entry region 10 comprises a trough base 12 which, in the illustration, is designed with an incline or gradient 16 with respect to a dirt-collecting sieve 28. In the illustration according to FIG. 1, the trough base 12 runs with a continuous gradient 16. A gradient 16 which differs in degree, depending on the angle of inclination of the trough base 12, as indicated in FIG. 1, is produced depending on the length of the entry region 10 and working height at the entry region 10.

A flushing or washing container 18 is located at that end of the trough base 12 which faces away from the dirt-collecting sieve 28. The washing container 18 is preferably fitted rotatably between the sidewalls or cheeks 14 of the entry region 10. The washing container 18 can preferably be automatically deflected about its axis of rotation 20 after the filling with a stock of fluid, which is preferably water, has ended. In the illustration according to FIG. 1, the deflecting movement of the filled washing container 18 about the axis of rotation 20 is indicated by the arrow 72. The washing container 18 is preferably designed in the manner of a tub, with its container base 74 being less wide than a filling side 80 of the washing container 18. The washing container 18 is preferably filled with water, with it being possible for this to be washing water of any desired tank of the conveyor-type dishwasher. The water can be removed, for example, from the preliminary cleaning tank, a washing tank and an after-rinsing tank or from the pump-operated final-rinsing zone. On the other hand, fresh water can also be used to fill the washing container 18 via the filling side 80, fresh water having the advantage that a better cleaning effect can be obtained with regard to washing away impurities from the trough base 12.

It can be gathered from the illustration according to FIG. 1 that the container base 74 of the washing container 18 is illustrated in a closed position 76. In the variant embodiment illustrated in FIG. 1, the washing container 18 which receives the stock of fluid is illustrated in its filling position and is arranged pivotably about the axis of rotation 20. The receiving bearings (not illustrated in FIG. 1) of the axis of rotation 20 of the washing container in the cheeks 14 are preferably designed in such a manner that the washing container 18 can be hooked into them in a simple manner from the upper side of entry region 10 and is immediately positioned correctly. As an alternative to the embodiment illustrated in FIG. 1 of a washing container 18 which can be deflected about the axis of rotation 20, said washing container can also be arranged in a stationary manner, i.e. not arranged about its axis of rotation 20, and can be transferred from a closed position 76 into an open position 78 indicated by dashed lines by opening the container base 74 in order to permit emptying of the washing container 18.

In the illustration according to FIG. 1, the washing container 18 is arranged in such a manner that, by shifting of the center of gravity as a function of the stock of fluid present therein, it is automatically deflected about the axis of rotation 20 owing to the shifting of the center of gravity as the filling level of the washing container 18 increases. During emptying of the washing container 18 by means of a deflecting movement 72 about the axis of rotation 20, a gush of water 22 is produced which flows alone the trough base 12 in the direction of flow 24. During loading of the continuous conveyor belt (not illustrated in FIG. 1), food residues 26 which have dropped onto the trough base 12 are transported away in the direction of the dirt-collecting sieve 28 by the high-energy gush of water 22 and because of the gradient 16. The food residues indicated by reference number 26 in FIG. 1 may be fresh, i.e. not yet adhering or non-emulsified food residues and also food residues which may already have been lying on the trough base 12 for a longer period of time of some hours and accordingly may already been stuck there. Owing to the high energy content of the gush of water 22, food residues 26 which are already stuck on the trough base 12 can also be flushed or transported away from the entry region 10 by the gush of water 62.

Instead of a deflecting movement 72 about the axis of rotation 20 that occurs as a function of the shifting of the center of gravity during filling of the washing container 18, it is also conceivable to operate the washing container 18 by electric motor, to empty and fill it continuously in certain cycles or to deflect the washing container 18 about its axis of rotation 20, for example by means of a spring mechanism or the like such that food residues 26 are continuously washed away from the trough base 12. As a function of the fluid content of the washing container 18 and as a function of the gradient 16 of the trough base 12, it can be ensured, by means of the number of emptying operations, that, even when there is a small gradient 16 of the trough base 12, fluid residues 26 sticking on the latter are transported away in the direction of the dirt-collecting sieve 28.

A conveyor-type dishwasher, in which the entry region is oriented horizontally, i.e. is not lowered with respect to the washing zones to be passed through, can be gathered from the illustration according to FIG. 2 which shows the entry region 10 which, analogously to the illustration according to FIG. 1, has the trough base 12 running at the gradient 16, and also cheeks 14 provided in a vertical arrangement on both sides of the trough base 12. The axis of rotation 20 of the upwardly open washing container 18 is accommodated in the two cheeks 14. The high-energy gush of water 22 illustrated in FIG. 1 rinses the food residues 26 which have passed to the trough base 12 to the dirt-collecting sieve 28 arranged downstream with respect to the trough base 12. According to the illustration in FIG. 2, the trough base 12 of the entry region 10 is located below a loading zone 30. Within the loading zone 30, a continuous conveyor belt 34, which conveys items to be cleaned through the conveyor-type dishwasher, is fitted on holding devices, such as, for example, holding pegs 36 of the conveyor belt 34. Food residues contained on the items to be cleaned drop onto the trough base 12 which is arranged at a gradient 16 with respect to the upper edge of the entry region. The entry region 10 of the conveyor-type dishwasher illustrated in FIG. 2 is adjoined by a first rinsing zone 38 of the conveyor-type dishwasher. The first rinsing zone 38 is assigned a heat exchanger 40 which is arranged above the rinsing zone 38. A fan 42 with which moist air can be extracted from the first rinsing zone 38 over the shortest distance is located above the heat exchanger 40. Furthermore, the first rinsing zone 38 is assigned a rinsing tank 44 which is covered by the dirt-collecting sieve 28 already mentioned. The food residues 26 rinsed away by the gush of water 22 during emptying of the wash container 18 pass to the dirt-collecting sieve 28. The intake of the recirculating pump 46 is located below the dirt-collecting sieve 28 which covers the rinsing tank 44. Water can be removed from the rinsing tank 44 by the recirculating pump 46, by means of a bypass, and used for filling the washing container 18. In addition to water which is stored in the rinsing tank 44, the deflectable, rotatably mounted washing tank 18 can also be filled with water which is taken from a preliminary cleaning tank, a washing tank, an after-rinsing washing tank or the like. In addition, it is also possible to use fresh water to fill the washing container 18, which is mounted rotatably in the cheeks 14, via the filling side 80 of the container, which further improves the cleaning action with regard to the trough base 12.

It is revealed from the illustration according to FIG. 2 that, also in this embodiment, the washing container 18 is mounted rotatably about the axis of rotation 20 in the cheeks 14 of the entry region 10. Instead of a washing container 18 which is mounted rotatably about its axis of rotation 20 and is deflected by a shifting of the center of gravity, which occurs during the filling with water, and is thereby emptied, use can also be made of a washing container 18, the container base 74 of which automatically opens—for example at a certain degree of filling of the washing container—and, without a deflecting movement 72 of the washing container 18 as a whole, empties the volume of water stored within the washing container 18 onto the trough base 12.

The filling position, i.e. the position into which the previously emptied washing container 18 is brought with respect to its axis of rotation 20 for refilling, is defined by a stop and the center of gravity of the emptied washing container 18. The washing container 18 passes into the emptying position on account of the shifting of the center of gravity, which occurs during filling, which leads to the deflecting movement 72 of the washing container 18 about the axis of rotation 20. If the stored stock of water which has collected in the washing container 18 leaves the latter, the dead weight of said container places it back again into its filling position such that it can be filled with water again.

With regard to the filling of the washing container 18, this can take place cyclically continuously or discontinuously, with it being possible for a filling quantity of the washing container 18 to lie within the range of a few liters of water, for example 3 to 5 liters of water. The gradient 16 at which the trough base 12 runs with respect to the horizontally extending upper edge of the cheeks 14 of the entry region 10 is between 3° and 12°, depending on the overall length of the entry region 10 with respect to the plane in which the dirt-collecting sieve 28 is arranged above the rinsing tank 44.

The illustration according to FIG. 3 illustrates an extended entry region which is connected upstream of a conveyor-type dishwasher.

It can be gathered from the illustration according to FIG. 3 that, in comparison to the entry region according to the embodiment in FIG. 2, the entry region 10 is in a lowered position with respect to the first rinsing zone 38 of the conveyor-type dishwasher. It is revealed in the embodiment, illustrated in FIG. 3, of the entry region 10 proposed according to the invention that the entry region 10 has a trough base 12 which has a first sloped section 52 and a second sloped section 54. The first and second sloped sections 52, 54 extend on opposite sides of an apex point (referred to by reference number 50) of the trough base. In the illustration according to FIG. 3, at least one washing container 18 is arranged above this apex point 50. It is illustrated in FIG. 3 that the first sloped section 52 and the second sloped section 54 extend at different lengths. Whereas the first sloped section 52 runs from the apex point 50 in the direction of a deflecting wheel 48 of the continuous conveyor belt 34, the second sloped section 54 extends from the apex point 50 to the beginning of the first rinsing zone 38, i.e. the dirt-collecting sieve 28. FIG. 3 shows that the lowered entry point 70 in FIG. 3 comprises the continuous conveyor belt 34 which runs in the conveying direction 32. The conveyor belt 34 revolves via at least one deflecting wheel 48 which is advantageously mounted rotatably on the inside of each cheek 14. The conveyor belt 34 comprises holding devices, such as, for example, holding pegs 36, into which items 56 to be cleaned are fitted within the loading zone 30 either manually or via automatic loading devices onto the holding devices 36 of the conveyor belt 34 moving in the conveying direction 32. During loading of the conveyor belt 34 above the trough base 12, i.e. which comprises the first sloped section 52 and the second sloped section 54, food residues, such as paper, fruit peelings, serviettes or the like, which drop don are detached from the upper side of the trough base 12 upon deflection of the washing container 18 in one or the other direction, i.e. in the clockwise direction with respect to the second sloped section 54 and counterclockwise with respect to the first sloped section 52, and rinsed away on account of the high-energy gush of water 22.

The first sloped section 52 extends from the apex point 50 in the direction of a filtering stage 60 of two-stage design. Below the filtering stage 60 there is a siphon bend 62 which is connected to a discharge pipe 64 leading into a sewerage system running in the floor 66.

The second sloped section 54 extends from the apex point 50 at a somewhat greater gradient 16 to the edge of the dirt-collecting sieve 28 above the rinsing tank 44.

For the sake of completeness, it should be mentioned that the first rinsing zone 38 is assigned the heat exchanger 40, above which the fan 42 for extracting moist air from the interior of the first rinsing zone 38 is assigned.

Instead of the one washing container 18 illustrated in FIG. 3, a plurality of washing containers 18 can also be arranged in cascade form along the first sloped section 52. Whereas the washing container 18 illustrated in FIG. 3 is mounted rotatably about the axis of rotation 20, the washing container 18 may alternatively also be configured in such a manner that it can be emptied by opening of the container base 74—as already mentioned in conjunction with FIG. 1. The most effective position of the washing container is at the highest point of the trough base, i.e. above the apex point 50 in the illustration according to FIG. 3. In the case of longer entry points, as illustrated in FIG. 3, a plurality of washing containers 18 can be arranged along the first sloped section 52. The washing container 18 illustrated in the embodiment according to FIG. 3 can be deflected in both directions, depending on requirements. If a plurality of washing containers 18 are used in the entry region 10 in the embodiment illustrated in FIG. 3, they may differ in shape and size in order to pour out at different washing-away times and different quantities of water in the manner of a gush of water over the trough base 12, whether it is formed with a first sloped section 52 or whether with a second sloped section 54. Different washing-away times and washing-away cycles can therefore be predetermined. The geometry of the washing container 18 may be asymmetrical or symmetrical, with a symmetrical shaping of the washing container 18 having the advantage that, if it is removed, for example for cleaning, it cannot subsequently be wrongly fitted again into its receiving bearing which is formed in the cheeks 14 of the entry region 10. The washing container 18 is fitted in such a manner that it is simple to remove and simple to clean. With the high-energy film of water produced in the entry region 12 by means of at least one washing container, large food residues, as indicated in conjunction with FIG. 1, and papers, serviettes, fruit peelings or the like can be washed away, as a result of which, according to the solution proposed according to the invention, covering sieves previously used in the entry region 10 of conveyor-type dishwashers are now no longer required.

It is to be mentioned in conjunction with FIG. 3 that the loading of the holding devices 26 of the conveyor belt 34, which revolves in the conveying direction 32, firstly can take place manually within the loading zone 30 and secondly can be undertaken by automatic loading devices illustrated in FIG. 3. As an alternative, baskets 58 can also be accommodated on the conveyor belt 34 and, for their part, are filled with items 56 to be cleaned. Both variant embodiments are possible and are dependent on the degree of automation in the entry region 10 of the conveyor-type dishwasher. A common feature of both the loading variants within the loading zone 30 is that, during the loading of the conveyor belt 34, whether with the direct loading of the holding device 26 with the items 56 to be cleaned, or whether with the placing of baskets 58 loaded with items 56 to be cleaned onto the conveyor belt 34, food residues 26 contained on the items 56 to be cleaned drop down onto the trough base 12 or onto the first and second sections 52, 54.

A further embodiment of the entry region proposed according to the invention, in this form arranged in a horizontal fitted position, can be gathered from the illustration according to FIG. 4. In this embodiment, the trough base 12 within the entry region 10 comprises the first sloped section 52 and the second sloped section 54 which is of considerably shorter design. The end of the second sloped section 54 extends from the apex point 50 to the beginning of the dirt-collecting sieve 28 above the rinsing tank 44. In an analogous manner to the illustration according to FIG. 3, the first sloped section 52 extends from the apex point 50 to the filtering stage 60 which is of two-stage design. In this embodiment, the at least one washing container 18 is arranged to the side of the apex point 50 and above the beginning of the first sloped section 52. The first sloped section 52 has a larger area with regard to the apex point 50 than the second sloped section 54. The gradient 16 of the first sloped section 52 is also greater than the gradient 16 established on the second sloped section 54. It is revealed from the illustration according to FIG. 4 that the washing container 18, which is arranged offset with respect to the apex point 50, can be deflected about the axis of rotation 20. The axis of rotation 20 is mounted in the cheeks 14 bounding the entry region 10. The washing container 18 used in the embodiment according to FIG. 4 is a washing container which is automatically deflected about the axis of rotation 20 on account of the shifting of the center of gravity which arises during filling with water, and pours out its content in the manner of a gush of water and in the form of a high-energy stream of water onto the trough base 12 of the first slope 52. Food residues 26 which have dropped from the items 56 to be cleaned onto the first sloped section 52 during loading of the conveyor belt 34 moving in the conveying direction 32 are discharged directly into the second filtering stage 60 by the high-energy gush of water. Whereas the filtering stage 60 is of two-stage design in the illustration according to FIG. 4, it may equally be only of single-stage design or else of multi-stage design, depending on the intended use of the conveyor-type dishwasher.

It can furthermore be gathered from FIG. 4 that the conveyor belt 34 which runs in the transporting direction 32 is deflected at a deflecting wheel 48 and is loaded with the items to be cleaned 56 from the upper side within the loading zone 30. Instead of direct loading of the holding device 36 with items to be cleaned, the transporting basket 58, which for its part contains items to be cleaned 56, can simply also be fitted onto the conveyor belt 34 moving in the conveying direction 32.

For the sake of completeness, it should be mentioned that the conveyor-type dishwasher illustrated in respect of the entry region in FIG. 4 comprises at least one rinsing zone 38 above which is arranged the heat exchanger 40 which, in turn, is assigned the fan 42 for extracting moist air from the first rinsing zone 38. The water stored in the rinsing tank 44 is recirculated via the pump 46 which, in the embodiment according to FIG. 4, is contained therein.

A common feature of all of the forms, illustrated in conjunction with FIGS. 1 to 4, of the solution proposed according to the invention is that at least one washing container 18 is arranged rotatably within the entry region 10, preferably at the highest position, for example above the apex point 50. In addition to the design of the at least one washing container 18 as being rotatable about an axis of rotation 20, the container base 74, as indicated in the illustration according to FIG. 1, can be brought from a closed position 76 into an open position 78 in order to bring about an emptying of the stock of water from the washing container 18 onto the trough base 12 and a streaming of the stock from the container in the manner of a gush over the trough base 12.

Either fresh water or recirculated water branched off within the rinsing tank 44, a preliminary cleaning tank or an after-rinsing washing tank or a tank from the pump-operated final-rinsing zone may be used to fill the at least one washing container 18. However, the cleaning effect when fresh water is used is more advantageous in comparison to the use of recirculated water. Reference number 82 refers to a stop against which, after emptying, the at least one washing container 18 pivots back about its axis of rotation 20 on account of its dead weight for re-filling. In the simplest case, the stop 82 may be designed as a rounded part on the end wall of the entry region 10.

The at least one washing container 18 proposed according to the invention can also be used on a trough base 12, 52, 54 in which an outlet nozzle is arranged at the highest point or on both sides of the apex point 50. The outlet nozzle can be used to produce a continuously flowing film of water which flows away uniformly over the surface of the trough base 12, 52, 54. The interaction of the film of water emerging in the trough base 12, 52, 54 via the outlet nozzle with the regular emptying operations of the at least one washing container 18 permits effective cleaning of the surface of the trough base on both sides of the apex point 50 or from a highest point of the trough base 12, above which the at least one washing container 18 to be emptied cyclically or regularly is arranged.

The foregoing relates to preferred exemplary embodiments of the invention, it being understood that other variants and embodiments thereof are possible within the spirit and scope of the invention, the latter being defined by the appended claims.

The invention claimed is:

1. An entry region of a conveyor-type dishwasher with a trough base having a gradient and sidewalls bounding the trough base laterally, and a conveyor belt which moves in a conveying direction, the entry region comprising at least one washing container disposed above the base for storing a stock of fluid, the at least one washing container being arranged at the highest point of the trough base and supported for movement about a horizontal axis of rotation to bring about an emptying of the fluid from the at least one washing container, the at least one washing container having a container base which can be brought from a closed position into an open position in order to additionally achieve an emptying of the fluid from the at least one washing container, and means for emptying the at least one washing container to clean the trough base, wherein the at least one washing container is emptied either by a deflecting movement about the horizontal axis of rotation or by opening of the container base.

2. The entry region as claimed in claim 1, wherein the at least one washing container has an open filling side.

3. The entry region as claimed in claim 1, wherein the at least one washing container is symmetrical with respect to its axis of rotation.

4. The entry region as claimed in claim 3, wherein the at least one washing container is emptied regularly or irregularly either by a deflecting movement produced by a shifting of the center of gravity during filling, or by regular or irregular opening of the container base.

5. The entry region as claimed in claim 1, wherein the at least one washing container has a trapezoidal cross section.

6. The entry region as claimed in claim 1, wherein the at least one washing container is mounted pivotably about an axis of rotation and removably in the sidewalls bounding the trough base.

7. The entry region as claimed in claim 1, wherein the at least one washing container is arranged at an apex point of the trough base.

8. The entry region as claimed in claim 1, wherein the at least one washing container is mounted for pivotal movement about a horizontal axis of rotation by shifting of the center of gravity during filling whereby the container is emptied, and, after emptying, is pivoted back into a filling position by its dead weight.

9. The entry region as claimed in claim 8, wherein the at least one washing container is emptied regularly or irregularly either by a deflecting movement produced by a shifting of the center of gravity during filling, or by regular or irregular opening of the container base.

10. The entry region as claimed in claim 1, wherein the dishwasher has a dirt-collecting sieve and/or a filtering stage of a single-stage or multi-stage, and wherein the at least one washing container is arranged with respect to the trough base in such a manner that food residue is washed away to the dirt-collecting sieve and/or the filtering stage.

11. The entry region as claimed in claim 10, wherein the at least one washing container is emptied regularly or irregularly either by a deflecting movement produced by a shifting of the center of gravity during filling, or by regular or irregular opening of the container base.

12. The entry region as claimed in claim 1, wherein the trough base has a continuous gradient.

13. The entry region as claimed in claim 1, wherein the trough base has a first sloped section and a second sloped section one on either side of an apex point, and the apex point is assigned at least one washing container which can be emptied in the direction of both sloped section.

14. The entry region as claimed in claim 13, wherein the at least one washing container is emptied regularly or irregularly either by a deflecting movement produced by a shifting of the center of gravity during filling, or by regular or irregular opening of the container base.

15. The entry region as claimed in claim 1, further comprising means for filling the at least one washing container with a stock of fluid which is represented either by fresh water or by recirculated water from a treatment zone of the conveyor-type dishwasher, which treatment zone is connected downstream of the entry region.

16. The entry region as claimed in claim 15, wherein the at least one washing container is emptied regularly or irregularly either by a deflecting movement produced by a shifting of the center of gravity during filling, or by regular or irregular opening of the container base.

17. The entry region as claimed in claim 1, wherein the filling position of the at least one washing container is defined by a position at a stop of the emptied at least one washing container on a boundary surface surrounding the trough base.

18. The entry region as claimed in claim 1, further comprising an outlet nozzle producing a continuous water film on the trough base.

19. The entry region as claimed in claim 1, wherein the at least one washing container is emptied regularly or irregularly either by a deflecting movement produced by a shifting of the center of gravity during filling, or by regular or irregular opening of the container base.

20. The entry region as claimed in claim 1, wherein the at least one washing container comprises a plurality of washing containers which differ in size and shape in order to produce different washing-away times and different quantities of water and therefore water films of differing energy.

* * * * *

UNITED STATES PATENT AND TRADEMARK OFFICE

CERTIFICATE OF CORRECTION

PATENT NO. : 7,874,301 B2
APPLICATION NO. : 11/964433
DATED : January 25, 2011
INVENTOR(S) : Axel Breitschuh It is certified that error appears in the above-identified patent and that said Letters Patent is hereby corrected as shown below:

Title Page, Item (73) Assignee: should read:

-- (73) Assignee: MEIKO Maschinenbau GmbH & Co. KG, Offenburg (DE) --.

Signed and Sealed this
Twenty-second Day of March, 2011

David J. Kappos

David J. Kappos
*Director of the United States Patent and Trademark Office*